US011273539B2

(12) United States Patent
Novitski

(10) Patent No.: US 11,273,539 B2
(45) Date of Patent: Mar. 15, 2022

(54) GLAD HAND CONNECTOR TOOL

(71) Applicant: Joel Novitski, Tomahawk, WI (US)

(72) Inventor: Joel Novitski, Tomahawk, WI (US)

( * ) Notice: Subject to any disclaimer, the term of this patent is extended or adjusted under 35 U.S.C. 154(b) by 119 days.

(21) Appl. No.: 16/745,911

(22) Filed: Jan. 17, 2020

(65) Prior Publication Data

US 2021/0220974 A1 Jul. 22, 2021

(51) Int. Cl.

| | |
|---|---|
| ***B25B 13/50*** | (2006.01) |
| ***B25B 13/02*** | (2006.01) |
| ***B25B 27/00*** | (2006.01) |

(52) U.S. Cl.

CPC ..... *B25B 13/5091* (2013.01); *B25B 13/02* (2013.01); *B25B 27/0028* (2013.01)

(58) Field of Classification Search

CPC . B25B 13/5091; B25B 13/02; B25B 27/0028; B25B 13/48; B25B 13/50; B25B 13/5033

USPC ..... 81/176.1–176.2, 177.2, 121.1

See application file for complete search history.

(56) References Cited

U.S. PATENT DOCUMENTS

| | | | | |
|---|---|---|---|---|
| 2,830,480 | A * | 4/1958 | Brame | B25B 13/02 81/176.15 |
| 4,634,151 | A | 1/1987 | Holt | |
| 6,058,813 | A * | 5/2000 | Bryant | B25B 13/02 81/124.2 |
| 6,314,841 | B1 | 11/2001 | Burk | |
| 6,609,445 | B2 | 8/2003 | Elmore | |
| D530,576 | S | 10/2006 | Levan | |
| 8,297,594 | B1 * | 10/2012 | Ontiveros | B25B 27/0035 254/25 |
| 8,347,762 | B2 | 1/2013 | Jones | |
| 2002/0095743 | A1 | 7/2002 | Schneider | |
| 2010/0307296 | A1 | 12/2010 | Jones | |
| 2011/0146462 | A1 * | 6/2011 | Watts, Sr. | B25B 13/04 81/125 |

* cited by examiner

*Primary Examiner* — Orlando E Aviles
*Assistant Examiner* — Thomas Raymond Rodgers
(74) *Attorney, Agent, or Firm* — Runyan Law; Charles Runyan

(57) ABSTRACT

A tool for use with a glad-hand connector; the tool includes a tool-body having a handle-end and a socket-end. The glad-hand connector includes a glad-hand body having a seal-side and a rear-side, and the socket-end includes an arcuate wall configured to encompass and conform to the rear-side of the glad-hand body. The tool is useful for facilitating coupling of glad hand connectors.

18 Claims, 5 Drawing Sheets

GLAD HAND CONNECTOR TOOL

CROSS-REFERENCE TO RELATED APPLICATION(S)

The present application is related to and claims priority to U.S. Provisional Patent Application No. 62/779,446 filed Dec. 13, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of tools of existing art and more specifically relates to glad hand connector tools.

RELATED ART

A glad hand connector or glad hand coupler is an interlocking hose coupling fitted to hoses supplying pressurized air from a tractor unit to air brakes on a semi-trailer. The glad hand connectors include a rubber seal, and to connect the glad hands, the two seals are pressed together. Truck drivers often have issues with stubborn glad hand connections. If they are not careful with the glad hands while attaching them to the trailer, they may break the hose or the fitting. If those are broken, the driver is unable to move their tractor/trailer until the broken pieces are replaced. A suitable solution is desired.

U.S. Pub. No. 2010/0307296 to Kenneth E. Jones relates to a Glad Hand Wrench. The described Glad Hand Wrench includes a device for engaging and rotating a glad hand. The device featuring a receptacle and an adaptor flange; the receptacle shaped to allow a glad hand to be seated therein. The receptacle formed by a base and at least one side wall extending from the base. The adaptor flange axially extending from an exterior surface of the base of the receptacle opposite the at least one side wall, the adaptor flange having a body, a central cavity and an open end opposite the base, the central cavity of the adaptor flange extending longitudinally within at least part of the body from the open end.

SUMMARY OF THE INVENTION

In view of the foregoing disadvantages inherent in the known hose connector art, the present disclosure provides a novel glad hand connector tool. The general purpose of the present disclosure, which will be described subsequently in greater detail, is to provide a tool for aiding in the coupling of glad hand connectors.

A tool is disclosed herein. The tool is for use with a glad-hand connector, the glad-hand connector including a glad-hand body having a seal-side and a rear-side opposite the seal-side. The tool includes a tool body including a handle-end and a socket-end. The tool body may be made from a rigid material and include an elongate flat profile defining a planar surface. The socket-end is located opposite the handle-end. The socket-end may include an arcuate wall extending vertically from the tool-body relative to the planar surface. The arcuate wall may be configured to encompass the rear-side of the glad-hand body.

According to another embodiment, a method of using a tool with a glad-hand connector is also disclosed herein. The method of using a tool with a glad-hand connector includes providing the tool as above; holding the handle-end; placing the socket-end over the rear-side of the glad-hand body; attaching the seal-side of the glad-hand body to a second glad-hand connector; and turning the handle-end to secure the glad-hand connector to the second glad-hand connector.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a glad hand connector tool, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a hose connector device and more particularly to a glad hand connector tool as used to improve installing and removing glad hand connectors from tractor/trailer connections.

Generally disclosed is a tool including a flat elongated body with a handle on one end and a socket on an opposite end. The socket-end may include a socket-sized opening to fit over a rear of the glad hand connector. The tool may be made from steel, pipe, etc. The tool may be configured to fit over the glad hand connector to allow a user to attach the socket to the glad hand, and proceed to utilize the tool to complete connection.

Referring now more specifically to the drawings by numerals of reference, there is shown in FIGS. 1-4, various views of a tool 100.

Figure 1:
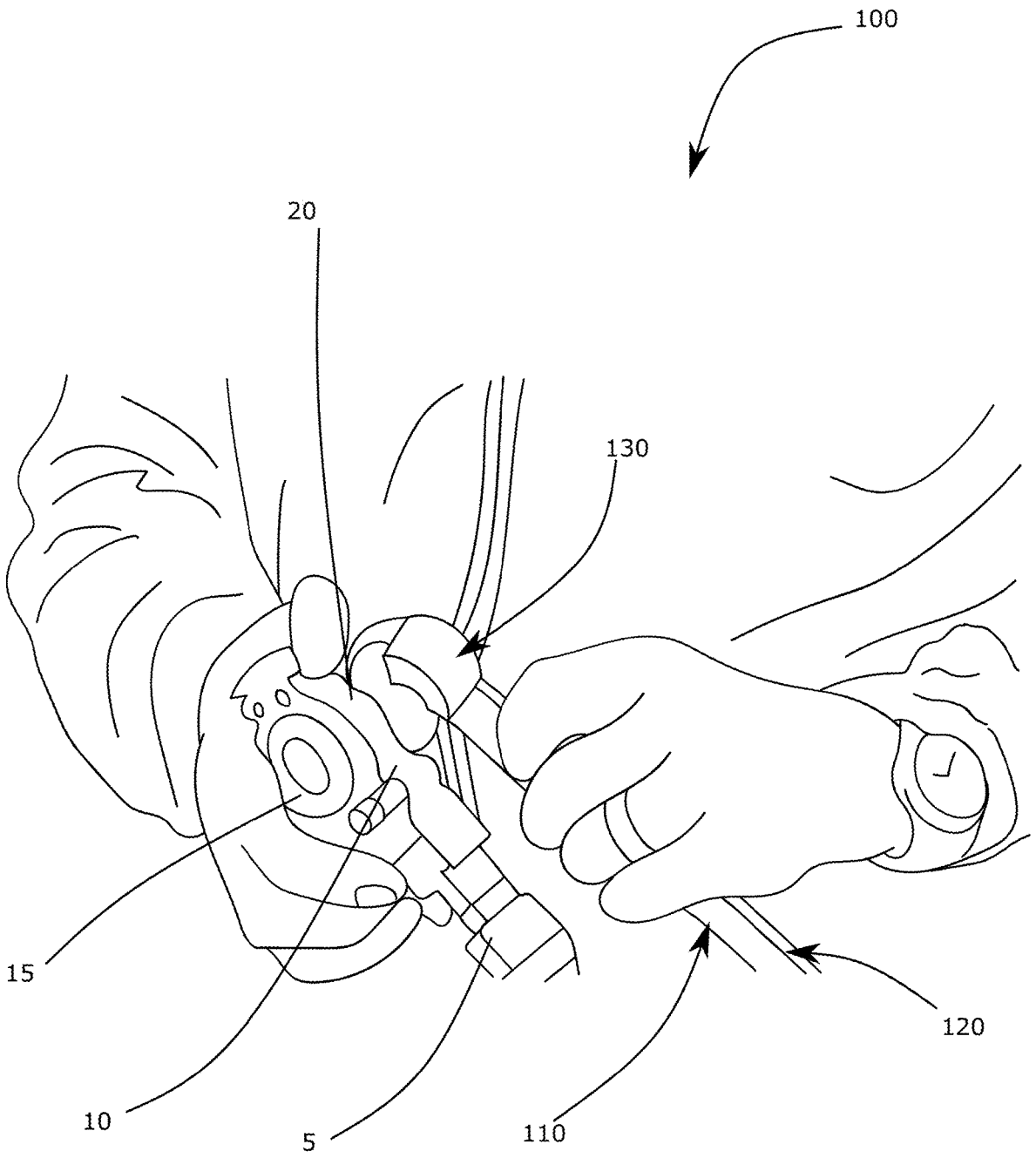
FIG. 1 is a side front view of the tool during an 'in-use' condition, according to an embodiment of the disclosure.

FIG. 1 shows a tool 100 during an 'in-use' condition, according to an embodiment of the present disclosure. Here, the tool may be beneficial for use by a user 40 to facilitate coupling of glad hand connectors. As illustrated, the tool 100 may include a tool-body 110 including a handle-end 120 and a socket-end 130. The tool 100 may be used with a glad-hand connector 5, the glad-hand connector 5 including a glad-hand body 10 having a seal-side 15 and a rear-side 20 opposite the seal-side 15.

According to one embodiment, the tool 100 may be arranged as a kit. In particular, the tool 100 may further include a set of instructions. The instructions may detail functional relationships in relation to the structure of the tool 100 such that the tool 100 can be used, maintained, or the like, in a preferred manner.

Figure 2A:
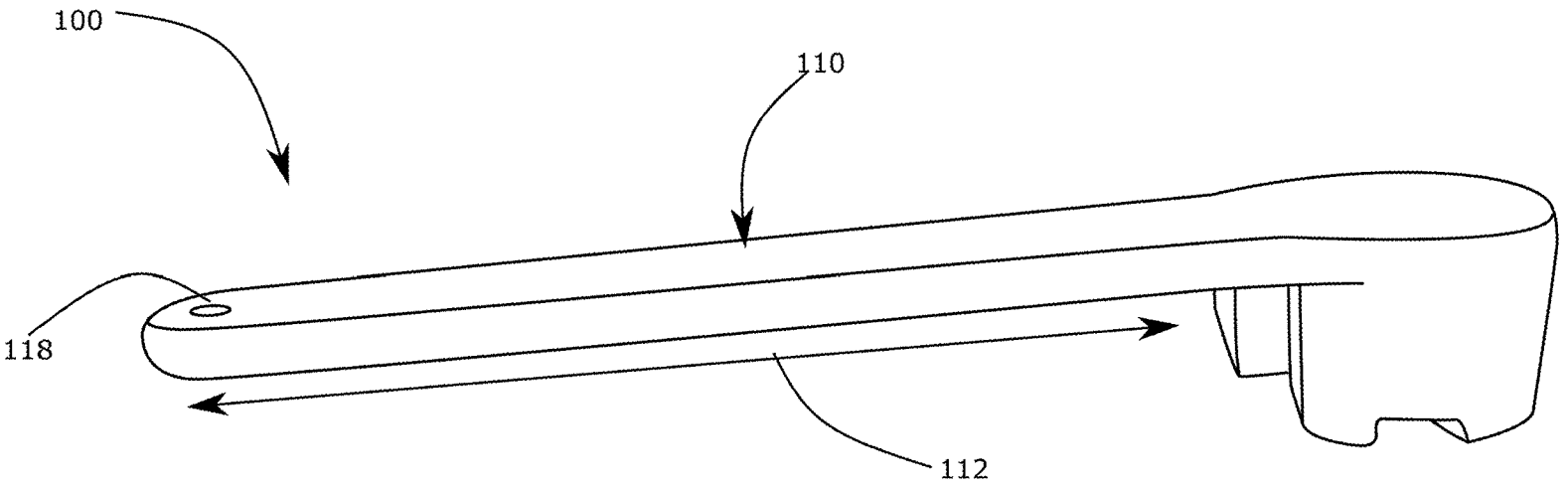
FIG. 2A is a side view of the tool of FIG. 1, according to an embodiment of the present disclosure.
Figure 2B:
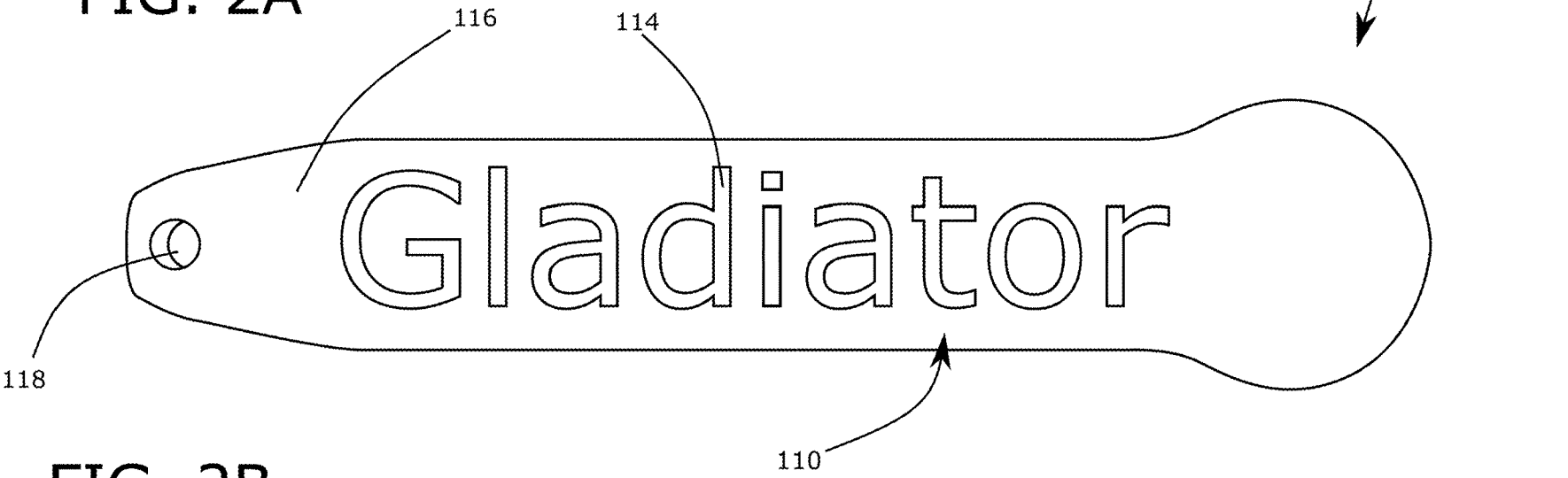
FIG. 2B is a rear view of the tool of FIG. 1, according to an embodiment of the present disclosure.

FIGS. 2A-2B show the tool 100 of FIG. 1, according to an embodiment of the present disclosure. Preferably, the tool-body 110 may be made from a rigid material. In one embodiment, the tool-body 110 may comprise a metal material. In one embodiment, the tool-body 110 may include a metal alloy material. However, other materials are contemplated. It is expected that the tool-body 110 be of sufficient rigidity to not bend or break under pressure exerted by a user connecting two glad-hand connectors together via the tool 100. The tool-body 110 may further include an elongate flat profile defining a planar surface 112. The tool-body 110 may be between 8-11 inches long and between 0.2-0.5 inches in thickness. In one embodiment, the tool-body 110 may be 9 inches long. In addition to this, the tool-body 110 may include functional indicia 114 thereon. In some embodiments, the functional indicia 114 may be located on a bottom-surface 116 of the tool-body 110.

As above, the tool-body 110 includes the handle-end 120 and the socket-end 130. Preferably, the handle-end 120 may be tapered. This may allow for better grasp-ability for the user of the tool 100. Further, in some embodiments, the handle-end 120 may include an aperture 118. The aperture 118 may be used in storage of the tool. For example, the tool may be hung on a hook via the aperture 118.

Figure 3A:
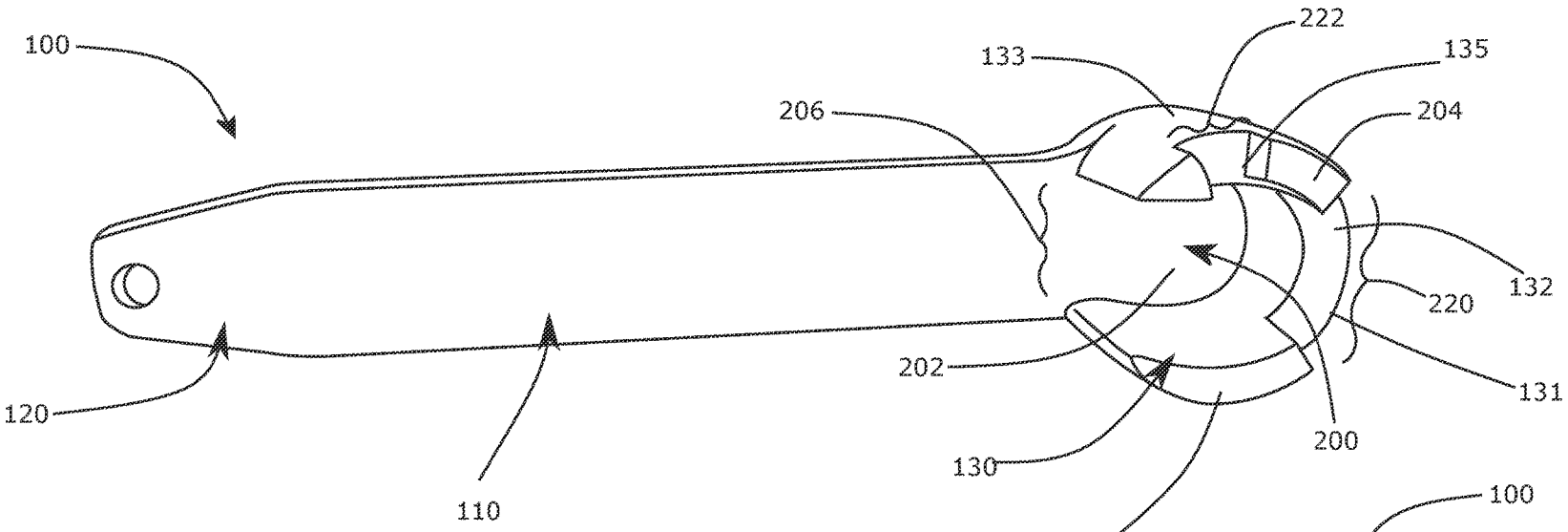
FIG. 3A is a front view of the tool of FIG. 1, according to an embodiment of the present disclosure.
Figure 3B:
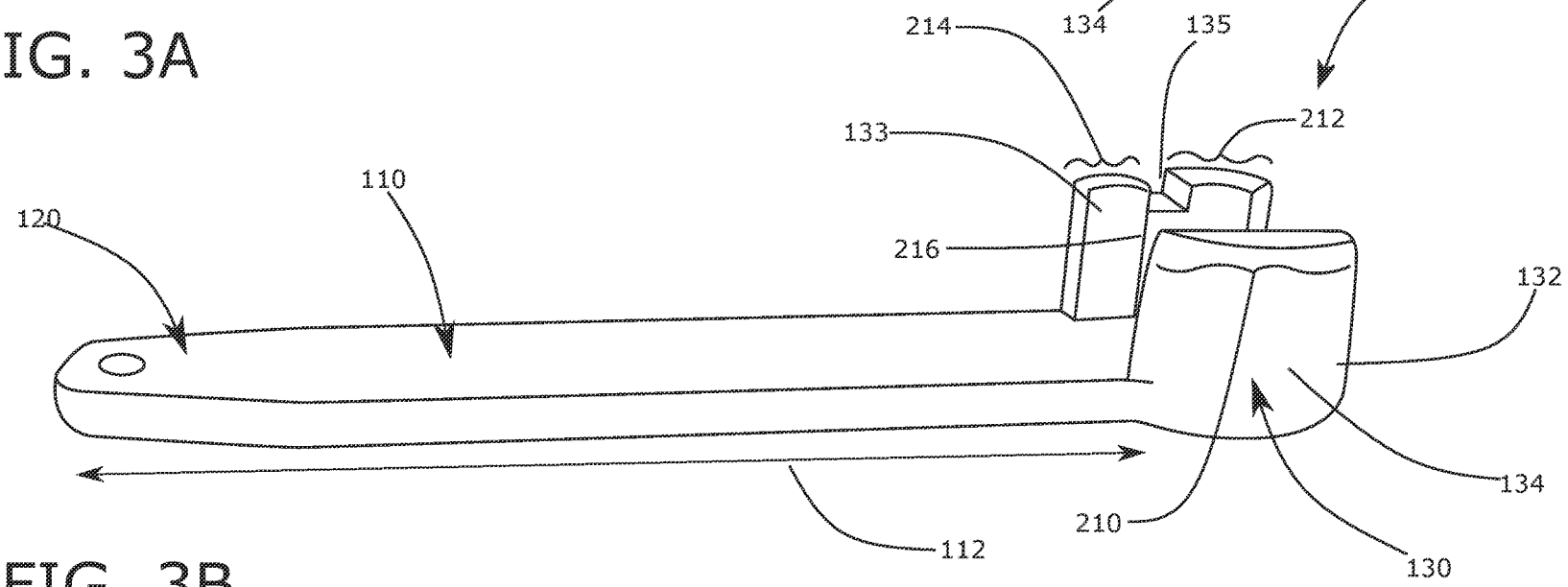
FIG. 3B is a side view of the tool of FIG. 1, according to an embodiment of the present disclosure.
Figure 3C:
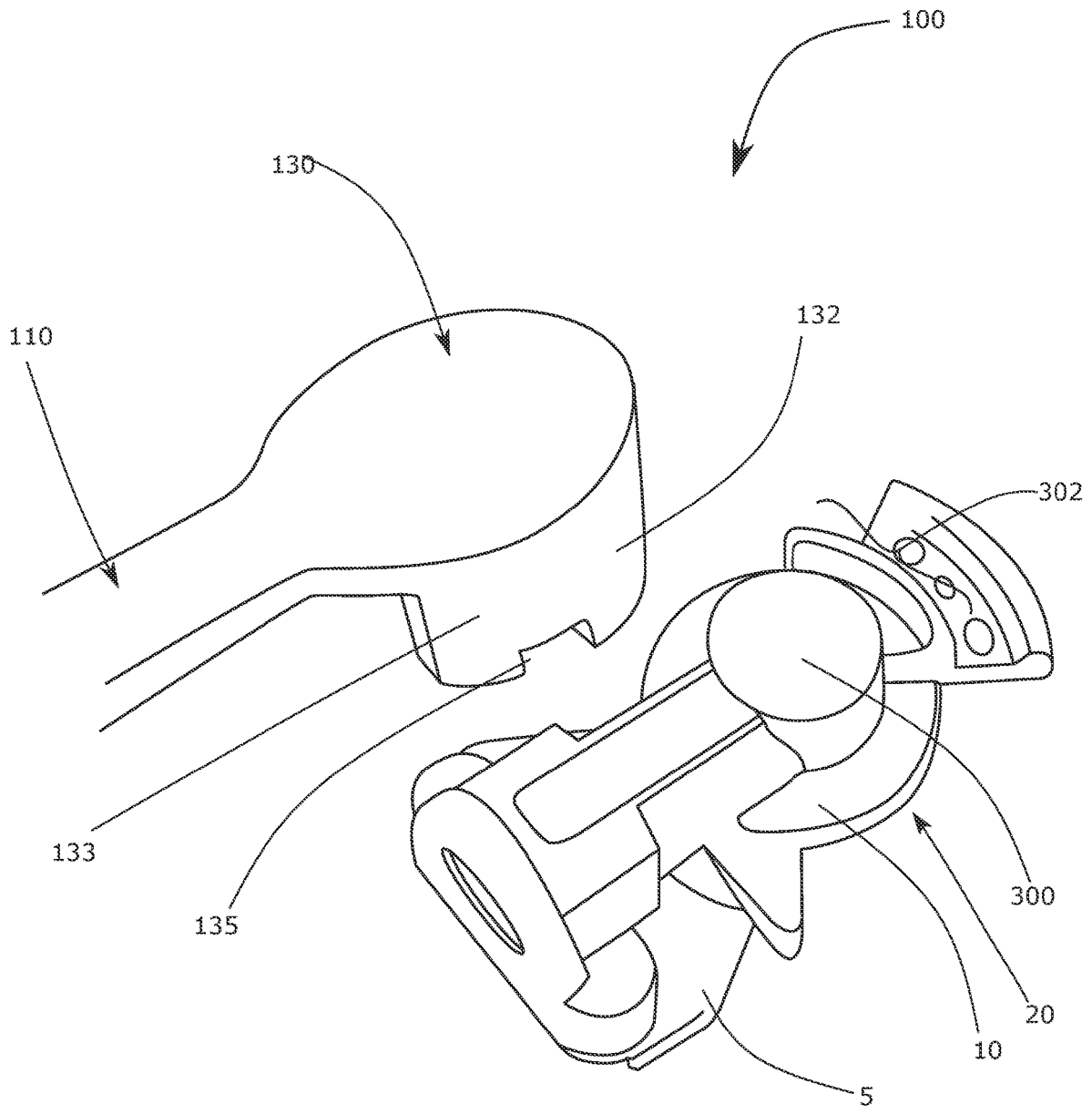
FIG. 3C is a side top view of the tool of FIG. 1, according to an embodiment of the present disclosure.

FIGS. 3A-3C show various views of the tool 100 of FIG. 1, according to an embodiment of the present disclosure. As shown, the socket-end 130 is located opposite the handle-end 120. The socket-end 130 may include an arcuate wall 132 extending vertically from the tool-body relative to the planar surface 112. The arcuate wall 132 may be defined by a first side 131 located at an end of the elongate flat profile opposite the handle-end 120, a second-side 133, and a third side 134 opposite the second side 133. The second side 133 and the third side 134 may both be between 1-⅓ inches in height; between 1.5-2 inches in length; and between 1.5-2.5 inches in width. In some embodiments, the socket-end 130 may be ⅞ inches in length. As a whole arcuate wall 132 is hollow and defines central cavity 200, which is sufficiently deep and large and diameter to accept cylindrical body 300 of glad-hand connector 5, while allowing a rim 204 of arcuate wall to rest against or very nearly rest against rear-side 20 of glad-hand connector 5. Arcuate wall 132 does not fully circumscribe central cavity 200, but is bounded and divided at one end by gap 206 as shown. Gap 206 fully divides arcuate wall 132, extending fully to the base of arcuate wall 132, such that central cavity 132, the deepest end (or floor) of gap 206, and the corresponding side and flat face of handle-end 120 are fully co-planar as illustrated. This gap 206 and continuous co-planar surface from central cavity 200 to handle-end 120 are necessary for the tool to accept glad-hand 5 in practice, as the hose-interface end and the hose itself connected to glad-hand connector 5 must be able to pass through gap 206 and alongside handle-end 120. For the purposes of this specification, "terminally coplanar" may describe the flushness of the bottom of a feature with another surface. Specifically, "terminally coplanar" means that a terminal end of a depth of a feature is coplanar with another feature. In the case of socket-end 130, gap 206 is terminally coplanar with floor 202 of central cavity 200, while first-slot 220 and second-slot 222 are not. Arcuate wall 132 may be additional defined by three tool projections which ended outwardly away from floor 202 of central cavity 200 in order to mechanically engage aspects of rear-side 20 of glad-hand connector 5. These three tool projections are identified as first-key 210, second-key 212, and third-key 214 as shown. First-key 210 and second-key 212 are divided by first-slot 220 as shown, while third-key 214 and second-key 212 are divided by second-slot 222 as shown. First-slot 220 is of a sufficient depth and breadth (i.e., angular width) to accept the radial protrusion 302 that is present on typical glad-hand connectors. Each of second-slot 222 and third-key 214 are shaped to engage irregular versions of glad-hand connector 5 when abnormally shaped or excessively wide radial protrusions 302 are encountered. Typically, these radial protrusions 302 are pie-shaped, and are usually fenced, as illustrated here. Both the bounding edges of the pie-shape and the fencing provide structural discontinuities which first-key 210 and second-key 212 (and sometimes also third-key 214 with shelf 216) may mechanically engage with in order to impart rotation to glad-hand connector 5. As illustrated in FIG. 3B, third-key 214 includes a shelf 216 extending outwardly from and interrupting arcuate wall 132, providing an additional discontinuity by which tool-head 130 may impinge upon rear-side 20 of glad-hand connector 5 in order to impart rotation. Except for shelf 216, arcuate wall 132 may be characterized by a continuously smooth arcuate interior surface as it circumscribes central cavity 200.

The arcuate wall 132 may be configured to encompass the rear-side 20 of the glad-hand body 10. Further, the arcuate wall 132 may be shaped to conform to the rear-side 20 of the glad-hand body 10. For example, one of the second side 133 and the third side 134 may include at least one groove 135 configured to conform to the rear-side 20 of the glad-hand body 10. In addition, the second side 133 and the third side 134 may extend higher than the first side 131, and the first side 131 may be configured to conform to a top of the rear-side 20 of the glad-hand body 10. The socket-end 130 may conform to any design, groove, protrusion, etc. on the rear-side 20 of the glad-hand body 10 to allow for a secure fit.

Figure 4:
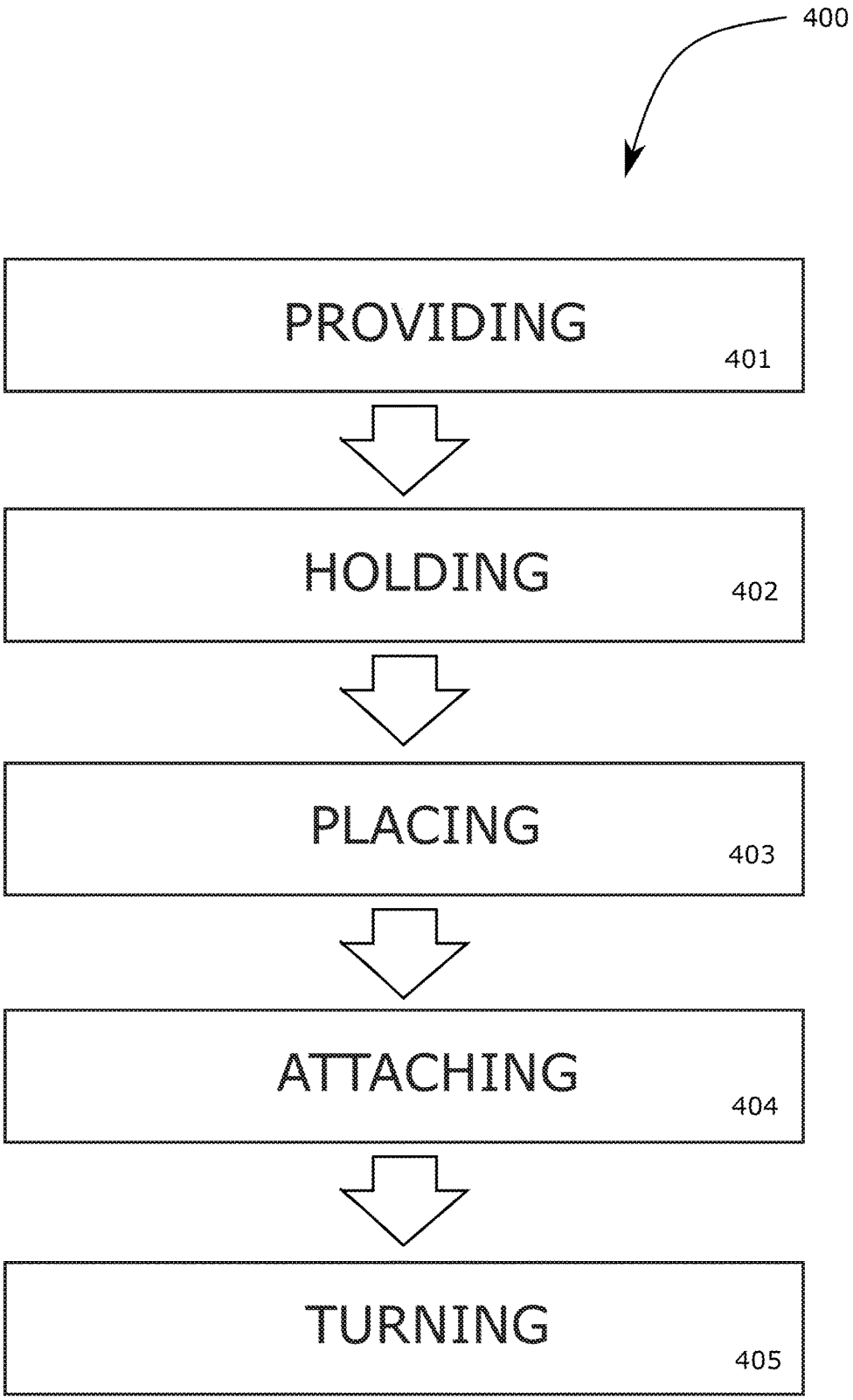
FIG. 4 is a flow diagram illustrating a method using a tool with a glad-hand connector, according to an embodiment of the present disclosure.

FIG. 4 is a flow diagram illustrating a method for using a tool 100 with a glad-hand connector, according to an embodiment of the present disclosure. In particular, the method for method for using a tool with a glad-hand connector 400 may include one or more components or features of the tool 100 as described above. As illustrated, the method for using a tool with a glad-hand connector 400 may include the steps of: step one 401, providing the tool as above; step two 402, holding the handle-end; step three 403, placing the socket-end over the rear-side of the glad-hand body; step four 404, attaching the seal-side of the glad-hand body to a second glad-hand connector; and step five 405, turning the handle-end to secure the glad-hand connector to the second glad-connector.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a tool with a glad-hand connector are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A tool for use with a glad-hand connector, the glad-hand connector including a glad-hand body having a seal-side and a rear-side opposite the seal-side, the rear-side comprising a cylindrical body and a radial protrusion, the tool comprising:

a tool-body made from a rigid material and including an elongate flat profile defining a planar surface, the tool-body further including:

a handle-end; and a socket-end opposite the handle-end, the socket-end including a central cavity able to accept the cylindrical body, an arcuate wall extending vertically from the tool-body relative to the planar surface, the arcuate wall circumscribing the central cavity and being interrupted by a gap divides the arcuate wall at one end, the gap being aligned with the handle-end, the arcuate wall itself having;

a rim able to engage with the rear-side of the glad-hand connector, a first-slot interrupting the rim, the first-slot defining a first-key from a second-key, the first-slot being able to accept the radial protrusion and impinge upon the radial protrusion when the central cavity is placed over the cylindrical body and the handle-end is rotated radially about the cylindrical body and, a second-slot interrupting the rim, the second-slot defining a third-key from the second-key, the second-slot opposing the gap across the central cavity, wherein the first-slot has a greater width than the second-slot to accept the radial protrusion of the glad-hand body whereby neither the first-slot or the second-slot are terminally coplanar with the handle-end, whereby a floor of the central cavity is coplanar with the handle-end, and whereby the gap is terminally coplanar with the handle-end and the floor of the central-cavity.

2. The tool of claim 1, wherein the arcuate wall is shaped to conform to the rear-side of the glad-hand body.

3. The tool of claim 2, wherein the first, second, and third keys are all between 1-1.5 inches in height.

4. The tool of claim 3, wherein the socket-end is between 1.5-2 inches in length.

5. The tool of claim 4, wherein the socket-end is 1⅞ inches in length.

6. The tool of claim 5, wherein the socket-end is between 1.5-2.5 inches in width.

7. The tool of claim 1, wherein the handle-end is tapered.

8. The tool of claim 7, wherein the tool-body is between 8-11 inches long.

9. The tool of claim 8, wherein the tool-body is 9 inches long.

10. The tool of claim 9, wherein the tool-body is between 0.2-0.5 inches in thickness.

11. The tool of claim 1, wherein the tool-body comprises a metal material.

12. The tool of claim 1, wherein the tool-body comprises a metal alloy material.

13. The tool of claim 1, wherein the tool-body includes functional indicia thereon.

14. The tool of claim 13, wherein functional indicia is located on a bottom-surface of the tool-body.

15. The tool of claim 1, wherein the handle-end includes an aperture.

16. A tool for use with a glad-hand connector, the glad-hand connector including a glad-hand body having a seal-side and a rear-side opposite the seal-side, the rear-side comprising a cylindrical body and a radial protrusion, the tool comprising:

a tool-body made from a rigid material and including an elongate flat profile defining a planar surface, the tool-body further including:

a handle-end; and a socket-end opposite the handle-end, the socket-end including a central cavity able to accept the cylindrical body, an arcuate wall extending vertically from the tool-body relative to the planar surface, the arcuate wall circumscribing the central cavity and being interrupted by a gap divides the arcuate wall at one end, the gap being aligned with the handle-end, the arcuate wall itself having:

a rim able to engage with the rear-side of the glad-hand connector, a first-slot interrupting the rim, the first-slot defining a first-key from a second-key, the first-slot being able to accept the radial protrusion and impinge upon the radial protrusion when the central cavity is placed over the cylindrical body and the handle-end is rotated radially about the cylindrical body and, a second-slot interrupting the rim, the second-slot defining a third-key from the second-key, the second-slot opposing the gap across the central cavity, wherein the first-slot has a greater width than the second-slot to accept the radial protrusion of the glad-hand body whereby neither the first-slot or the second-slot are terminally coplanar with the handle-end, whereby a floor of the central cavity is coplanar with the handle-end, and whereby the gap is terminally coplanar with the handle-end and the floor of the central-cavity;

wherein the arcuate wall is shaped to conform to the rear-side of the glad-hand body;

wherein the handle-end is tapered;

wherein the tool-body comprises a metal material; and wherein the tool-body includes functional indicia thereon.

17. The tool of claim 16, further comprising a set of instructions; and wherein the tool is arranged as a kit.

18. A method of using a tool with a glad-hand connector, the glad-hand connector including a glad-hand body having a seal-side and a rear-side opposite the seal-side, the method comprising the steps of:

providing the tool of claim 1;

holding the handle-end;

placing the socket-end over the rear-side of the glad-hand body;

attaching the seal-side of the glad-hand body to a second glad-hand connector; and turning the handle-end to secure the glad-hand connector to the second glad-hand connector.

* * * * *